US008459239B2

(12) United States Patent
Yamagishi

(10) Patent No.: US 8,459,239 B2
(45) Date of Patent: Jun. 11, 2013

(54) INTAKE DEVICE FOR MULTICYLINDER ENGINE

(75) Inventor: Naoto Yamagishi, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 990 days.

(21) Appl. No.: 12/393,246

(22) Filed: Feb. 26, 2009

(65) Prior Publication Data

US 2009/0241913 A1 Oct. 1, 2009

(30) Foreign Application Priority Data

Mar. 28, 2008 (JP) ..... 2008-086855

(51) Int. Cl.
*F02M 33/02* (2006.01)
*F02M 37/20* (2006.01)
*F02D 9/10* (2006.01)

(52) U.S. Cl.
USPC ..... 123/519; 123/336; 123/516

(58) Field of Classification Search
USPC ..... 123/299, 336, 519, 520, 521, 184.27, 123/184.35–184.37, 184.43–184.45, 184.48, 123/184.49, 184.52, 184.53, 516
See application file for complete search history.

(56) References Cited

U.S. PATENT DOCUMENTS

| | | | | |
|---|---|---|---|---|
| 4,630,581 | A * | 12/1986 | Shibata | 123/325 |
| 5,056,494 | A * | 10/1991 | Kayanuma | 123/519 |
| 6,202,626 | B1 * | 3/2001 | Ito et al. | 123/336 |
| 6,460,517 | B1 * | 10/2002 | Dauer | 123/520 |
| 7,152,577 | B2 * | 12/2006 | Nakagawa | 123/336 |

FOREIGN PATENT DOCUMENTS

| | | | |
|---|---|---|---|
| JP | 07-17951 | A | 1/1995 |
| JP | 08-128367 | A | 5/1996 |
| JP | 10-227222 | A | 8/1998 |
| JP | 2001-193501 | A | 7/2001 |
| JP | 2002-235620 | A | 8/2002 |
| JP | 2004-308532 | A | 11/2004 |
| JP | 2006-062413 | A | 3/2006 |
| JP | 2007-064068 | A | 3/2007 |
| JP | 2007-278217 | A | 10/2007 |

* cited by examiner

*Primary Examiner* — Stephen K Cronin
*Assistant Examiner* — Sizo Vilakazi
(74) *Attorney, Agent, or Firm* — Westerman, Hattori, Daniels & Adrian, LLP

(57) ABSTRACT

A compact intake device for a multicylinder engine includes fuel injection valves, vacuum conduits, and purge conduits compactly disposed on throttle bodies. First and second connecting tubes are disposed on a plurality of throttle bodies of a multicylinder engine and are open into intake passages in the throttle bodies substantially perpendicularly to the axes of the intake passages. The first and second connecting tubes are disposed in sandwiching relation to fuel injection valves. Purge conduits are connected to the first connecting tubes, and vacuum conduits are connected to the second connecting tubes.

5 Claims, 9 Drawing Sheets

INTAKE DEVICE FOR MULTICYLINDER ENGINE

TECHNICAL FIELD

The present invention relates to an improvement in an intake device for a multicylinder engine, including a plurality of throttle bodies mounted on the multicylinder engine and having intake passages corresponding to respective cylinders and throttle valves for opening and closing the intake passages, fuel injection valves mounted on the throttle bodies for injecting a fuel into the intake passages downstream of the throttle valves, and vacuum conduits connected to the throttle bodies for introducing a vacuum from the intake passages.

BACKGROUND OF THE INVENTION

Intake devices for multicylinder engines of the type described above are already known in the art as disclosed in Japanese Patent Laid-open No. Hei 10-227222, for example, given below.

Heretofore, it is known that purge conduits for releasing and guiding an evaporated fuel from a canister for storing the evaporated fuel, as well as fuel injection valves and vacuum conduits as disclosed in Japanese Patent Laid-open No. Hei 10-227222, are connected to throttle bodies of intake devices for multicylinder engines. However, since the fuel injection valves, the vacuum conduits, and the purge conduits are disposed in a dispersed layout, it has heretofore been difficult to make the intake devices compact.

SUMMARY OF THE INVENTION

The present invention has been made in view of the above problems. It is an object of the present invention to provide a compact intake device for a multicylinder engine wherein fuel injection valves, vacuum conduits, and purge conduits are compactly disposed on throttle bodies.

To achieve the above object, there is provided in accordance with a first feature of the present invention an intake device for a multicylinder engine, including a plurality of throttle bodies mounted on the multicylinder engine and having intake passages corresponding to respective cylinders and throttle valves for opening and closing the intake passages, fuel injection valves mounted on the throttle bodies for injecting a fuel into the intake passages downstream of the throttle valves, and vacuum conduits connected to the throttle bodies for introducing a vacuum from the intake passages, wherein the throttle bodies include first and second connecting tubes opening into the intake passages substantially perpendicularly to the axes of the intake passages, the connecting tubes being disposed in a sandwiching relation to the fuel injection valves, and purge conduits for releasing and guiding an evaporated fuel from a canister for storing the evaporated fuel are connected to the first connecting tubes, the vacuum conduits being connected to the second connecting tubes.

According to a second feature of the present invention, in addition to the first feature, the multicylinder engine includes a V-shaped engine having a V-shaped array of first and second banks each having a cylinder, the throttle bodies are mounted respectively on the first and second banks with the intake passages being directed vertically, the first and second connecting tubes are offset from each other along the axes of the intake passages, the purge conduits which extend from the first connecting tubes and a single common purge conduit are connected to each other through a first joint positioned between the throttle bodies on the first and second banks, and the vacuum conduits which extend from the second connecting tubes and a single common vacuum conduit are connected to each other through a second joint positioned between the throttle bodies on the first and second banks.

According to a third feature of the present invention, in addition to the second feature, each of the throttle bodies is connected to one of the first and second banks, and the throttle bodies are offset from each other along the axis of a crankshaft by an interval corresponding to an offset between the first and second banks, so that the first connecting tubes or the second connecting tubes are disposed substantially in line with each other.

According to a fourth feature of the present invention, in addition to the third feature, the throttle bodies have respective side surfaces coupled to each other by a first coupling plate and respective opposite side surfaces coupled to each other by a second coupling plate, thereby making up a throttle body assembly, and the purge conduits, the vacuum conduits, the first joint, and the second joint are disposed between the first and second coupling plates.

According to a fifth feature of the present invention, in addition to the second feature, the purge conduits, the common purge conduit, the vacuum conduits, and the common vacuum conduit are made of a flexible material, the first and second joints are made of a hard synthetic resin, and either (i) the first joint is disposed in a three-dimensionally intersecting position with the vacuum conduits or (ii) the second joint is disposed in a three-dimensionally intersecting position with the purge conduits.

According to the first feature of the invention, the fuel injection valves and the first and second connecting tubes project compactly on outer surfaces of the throttle bodies, making the intake device compact. The purge conduits and the vacuum conduits can be connected compactly and quickly to the first and second connecting tubes.

According to the second feature of the invention, a purge conduit system including the first joint and a vacuum conduit system including the second joint are vertically arranged, and their tubes are compactly put together without mutual interference. The fuel injection valves, the first and second connecting tubes, the purge conduits, and the vacuum conduits are disposed in a dead space between the throttle bodies of the first and second banks, contributing to making the intake device compact.

According to the third feature of the invention, since the first connecting tubes or the second connecting tubes are disposed substantially in line with each other, the purge conduits or the vacuum conduits that are connected to the connecting tubes which are disposed substantially in line with each other are also disposed substantially in line with each other. Therefore, the purge conduits or the vacuum conduits can be as short as possible and can be made compact, and any bending of the conduits is minimized for reducing an increase in the cost.

According to the fourth feature of the invention, the side surfaces of the throttle bodies on the first and second banks are coupled to each other by the first coupling plates and the respective opposite side surfaces thereof are coupled to each other by the second coupling plate, thereby making up a throttle body assembly. The throttle body assembly can easily be disposed between the first and second banks of the V-shaped engine. The purge conduits, the vacuum conduits, and the first and second joints are protected from contact with other objects by the first and second coupling plates.

According to the fifth feature of the invention, the purge conduits, the common purge conduit, the vacuum conduits, and the common vacuum conduit are made of a flexible material, and the first and second joints are made of a hard synthetic resin, so that the purge conduits and the common purge conduit can easily be connected to each other, and the vacuum conduits and the common vacuum conduit can easily be connected to each other. As either one of the first and second joints is disposed in a three-dimensionally intersecting position with either the purge conduits and the vacuum conduits, the purge conduits and the vacuum conduits are held out of contact with each other and hence are of increased durability.

BRIEF DESCRIPTION OF THE DRAWINGS

The advantages of the invention will become apparent in the following description taken in conjunction with the drawings, wherein.

DETAILED DESCRIPTION OF THE INVENTION

The present invention will be described below based on a preferred embodiment illustrated in the accompanying drawings.

Figure 1:
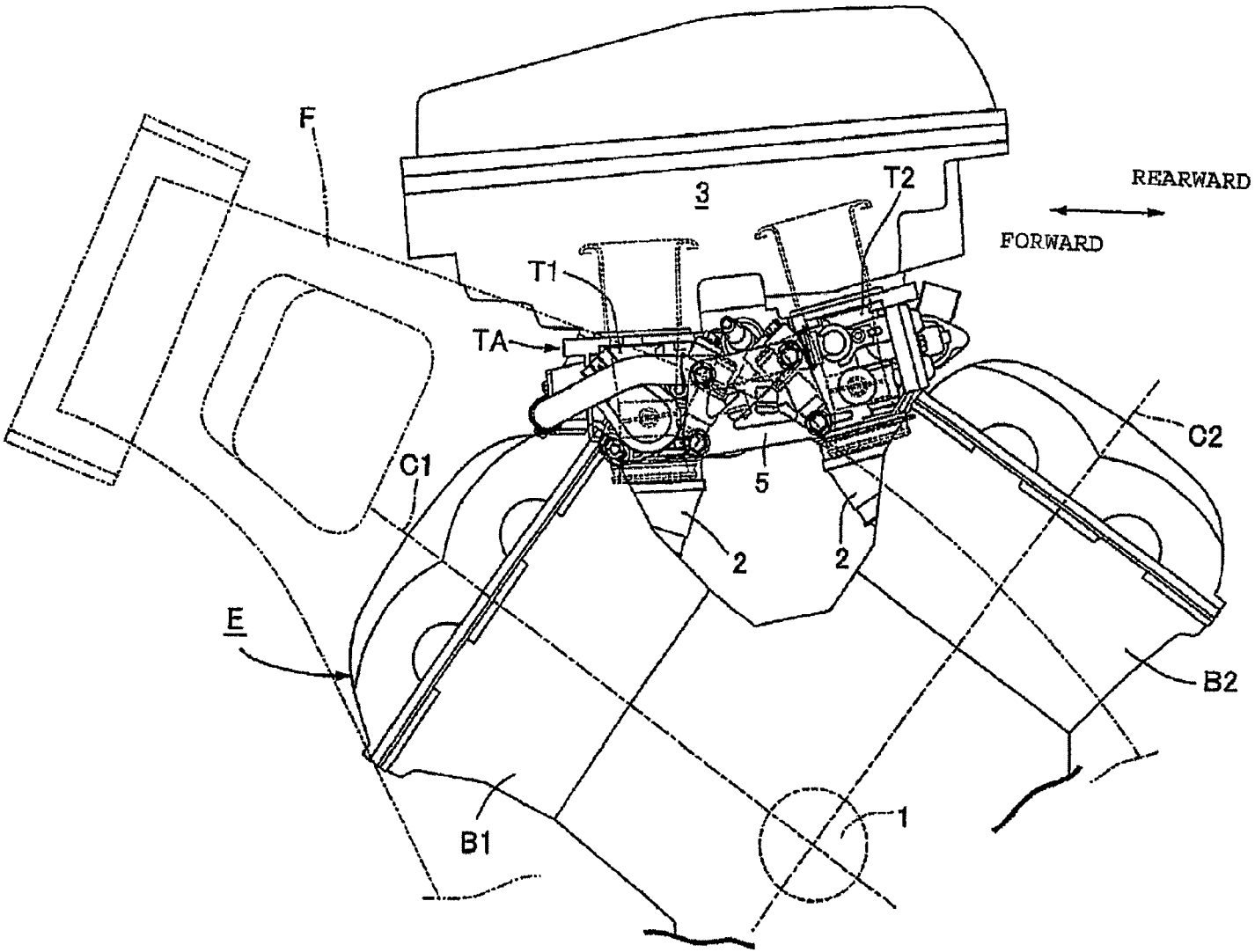
FIG. 1 is a fragmentary side elevational view of a V-shaped multicylinder engine for a motorcycle having an intake device according to an embodiment of the present invention.
Figure 2:
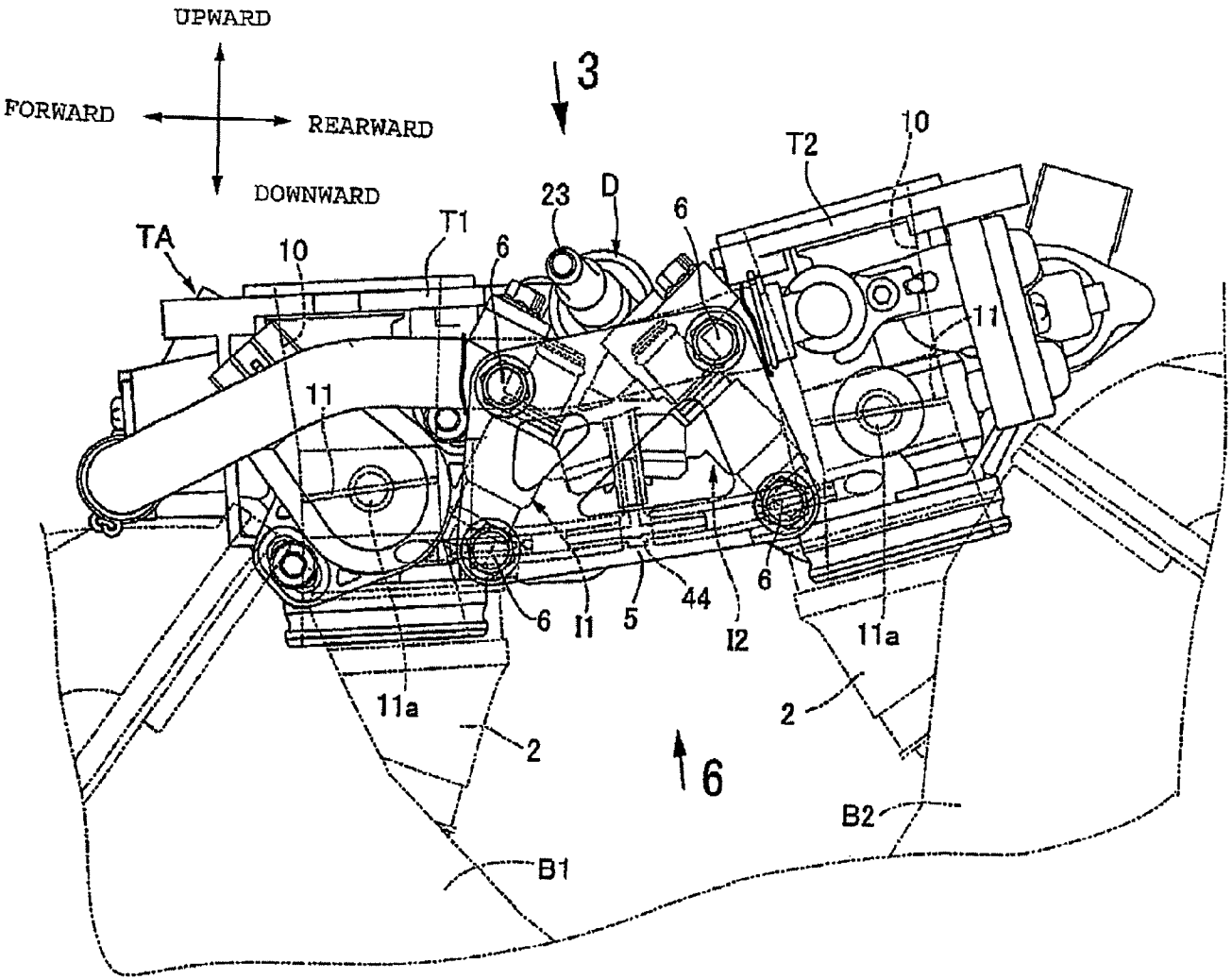
FIG. 2 is an enlarged view of a throttle body assembly shown in FIG. 1.

As shown in FIGS. 1 and 2, a V-shaped engine E mounted on a vehicle frame F of a motorcycle has a first bank B1 on a front side and a second bank B2 on a rear side. The first and second banks B1, B2 have respective cylinder axes C1, C2 tilted in a V shape about a crankshaft 1 which extends horizontally in the transverse direction of the motorcycle. In the illustrated embodiment, each of the first and second banks B1, B2 has a single cylinder.

Between the first and second banks B1, B2, there is disposed a throttle body assembly TA made up of first and second throttle bodies T1, T2 joined together and mounted respectively on resilient intake tubes 2, 2 corresponding to the respective cylinders. The first and second throttle bodies T1, T2 have respective intake passages 10, 10 directed vertically. A common air cleaner 3 for filtering intake air to be introduced into the intake passages 10, 10 of the first and second throttle bodies T1, T2 is disposed above the first and second throttle bodies T1, T2.

Figure 3:
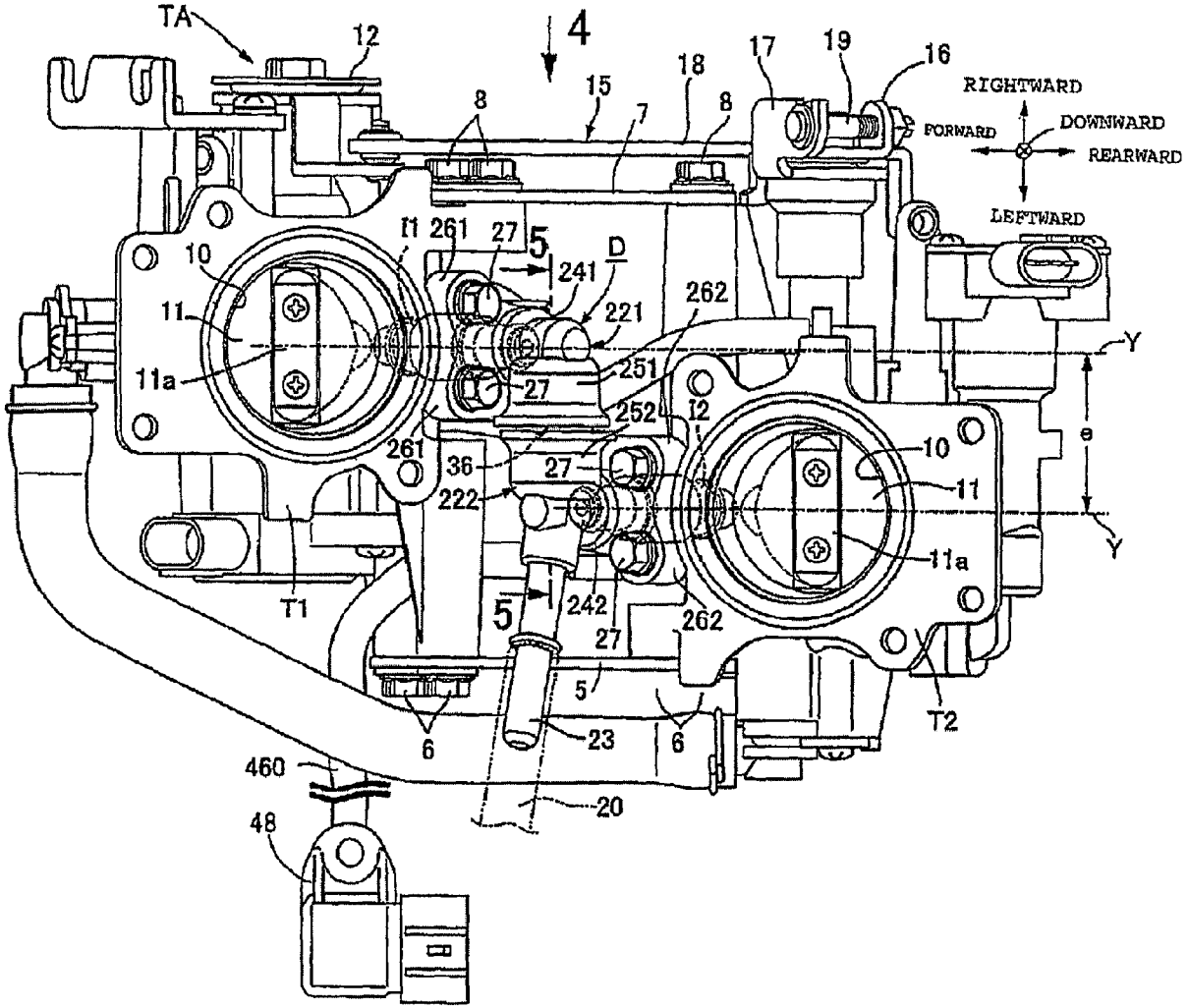
FIG. 3 is a view taken from the direction of arrow 3 of FIG. 2.
Figure 4:
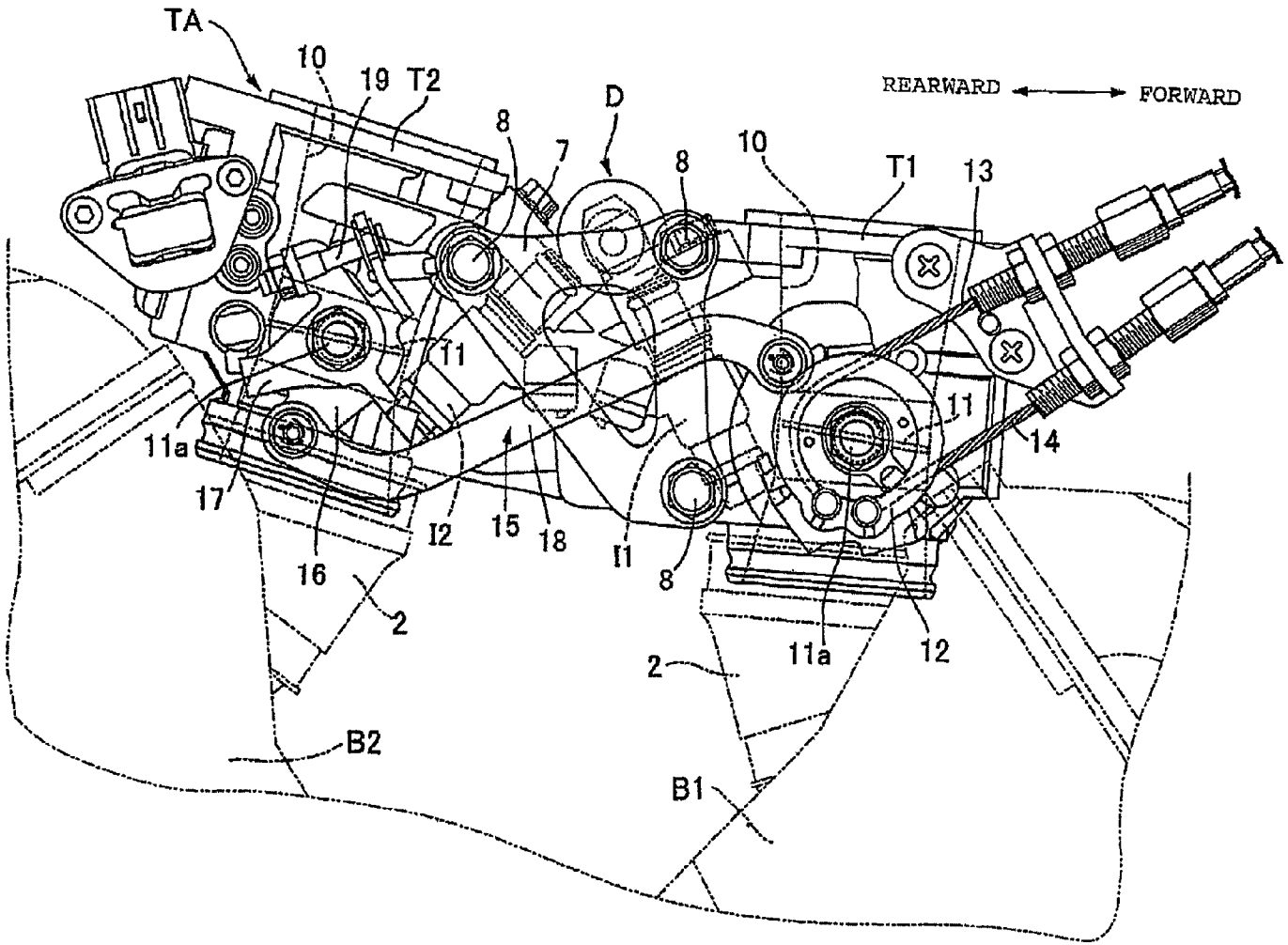
FIG. 4 is a view taken from the direction of arrow 4 of FIG. 3.

As shown in FIGS. 2 through 4, a first coupling plate 5 is coupled to side surfaces of the first and second throttle bodies T1, T2 by a plurality of bolts 6, and a second coupling plate 7 is coupled to opposite side surfaces thereof by a plurality of bolts 8. The first and second throttle bodies T1, T2 are joined to each other by the two coupling plates 5, 7, making up the throttle body assembly TA.

As shown in FIG. 3, the first and second throttle bodies T1, T2 are offset a constant distance e from each other in the axial direction of the crankshaft 1, as viewed in plan view. The offset distance e corresponds to a distance by which the first and second banks B1, B2 are offset from each other in the axial direction of the crankshaft 1. After the throttle body assembly TA is assembled, the downstream ends of the first and second throttle bodies T1, T2 are mounted respectively on the resilient intake tubes 2, 2 of the first and second banks B1, B2, so that the throttle body assembly TA is installed on the V-shaped engine E.

As shown in FIGS. 3 and 4, the throttle valves 11, 11 for opening and closing the respective intake passages 10, 10 have respective valve shafts 11*a*, 11*a* rotatably supported in the first and second throttle bodies T1, T2 substantially parallel to the crankshaft 1. An opening wire 13 and a closing wire 14 are connected to a throttle drum 12 which is fixed to one of the valve shafts 11*a* (in the illustrated embodiment, the valve shaft 11*a* of the first throttle body T1). When these wires are alternately pulled by reciprocating angular movement of the accelerator grip of the motorcycle, the throttle drum 12 is turned to open and close the throttle valve 11.

The angular movement of the throttle valve 12 is transmitted through an interlink mechanism 15 to the other valve shaft 11*a*. The interlink mechanism 15 includes a first throttle lever 16 rotatably supported on the other valve shaft 11*a* (in the illustrated embodiment, the valve shaft 11*a* of the second throttle body T2), a second throttle lever 17 fixed to the same valve shaft 11*a* adjacent to the first throttle lever 16, a link 18 interconnecting the throttle drum 12 and the first throttle lever 16, and a synchronizing screw 19 interconnecting the first and second throttle levers 16, 17 and capable of adjusting the relative phase between the throttle levers 16, 17. When the relative phase between the first and second throttle levers 16, 17 is adjusted, the throttle valves 11, 11 of the first and second throttle levers 16, 17 can be synchronized with each other.

Figure 6:
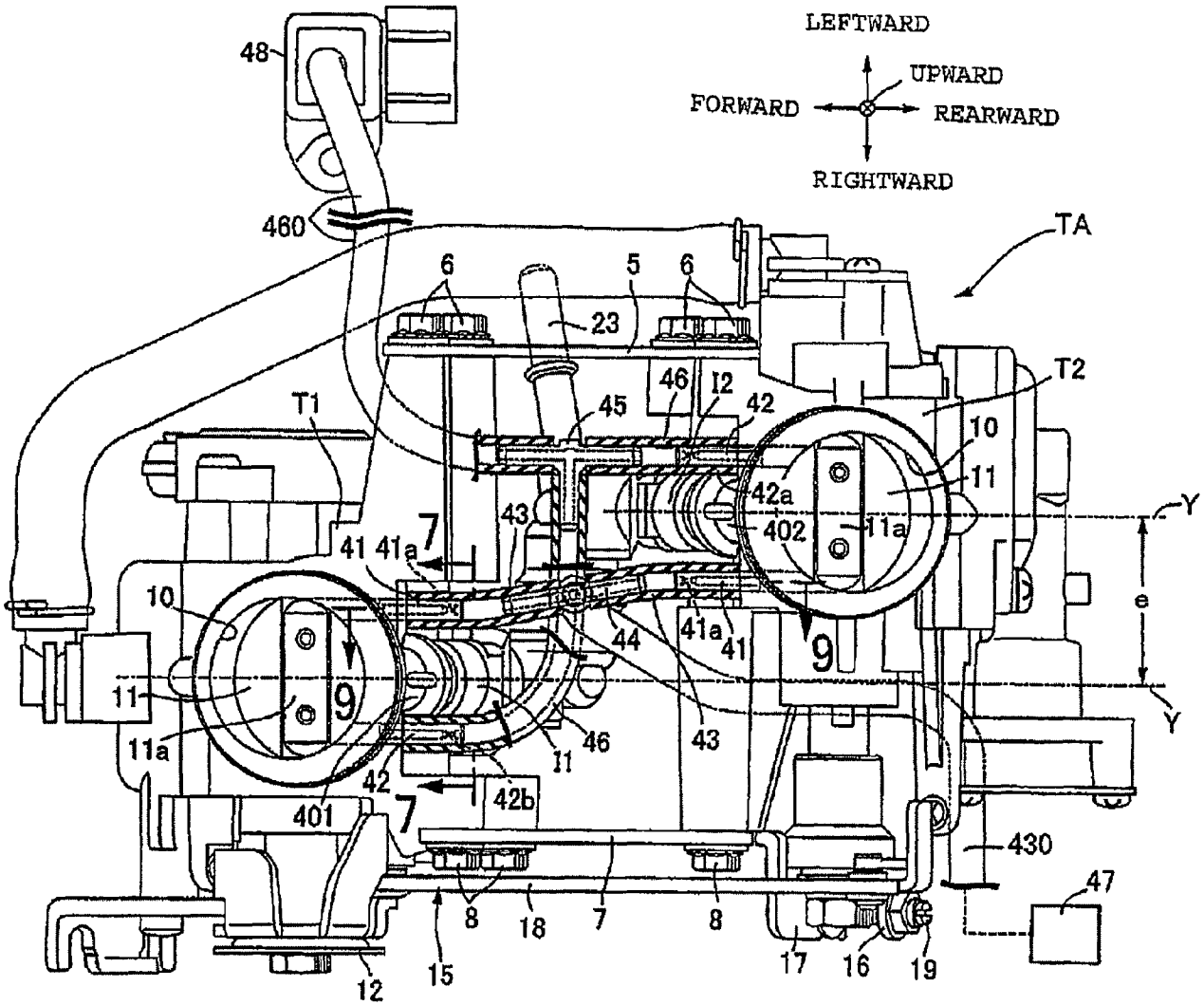
FIG. 6 is a view taken from the direction of arrow 6 of FIG. 2.
Figure 7:
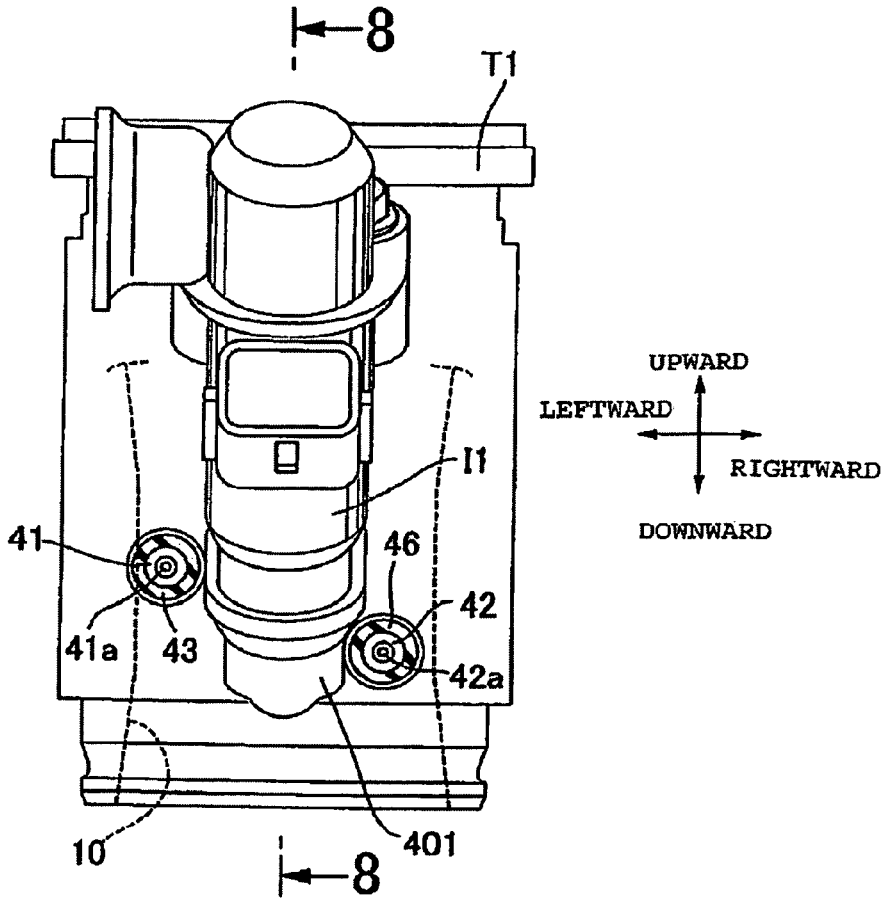
FIG. 7 is a cross-sectional view taken along line 7-7 of FIG. 6.
Figure 8:
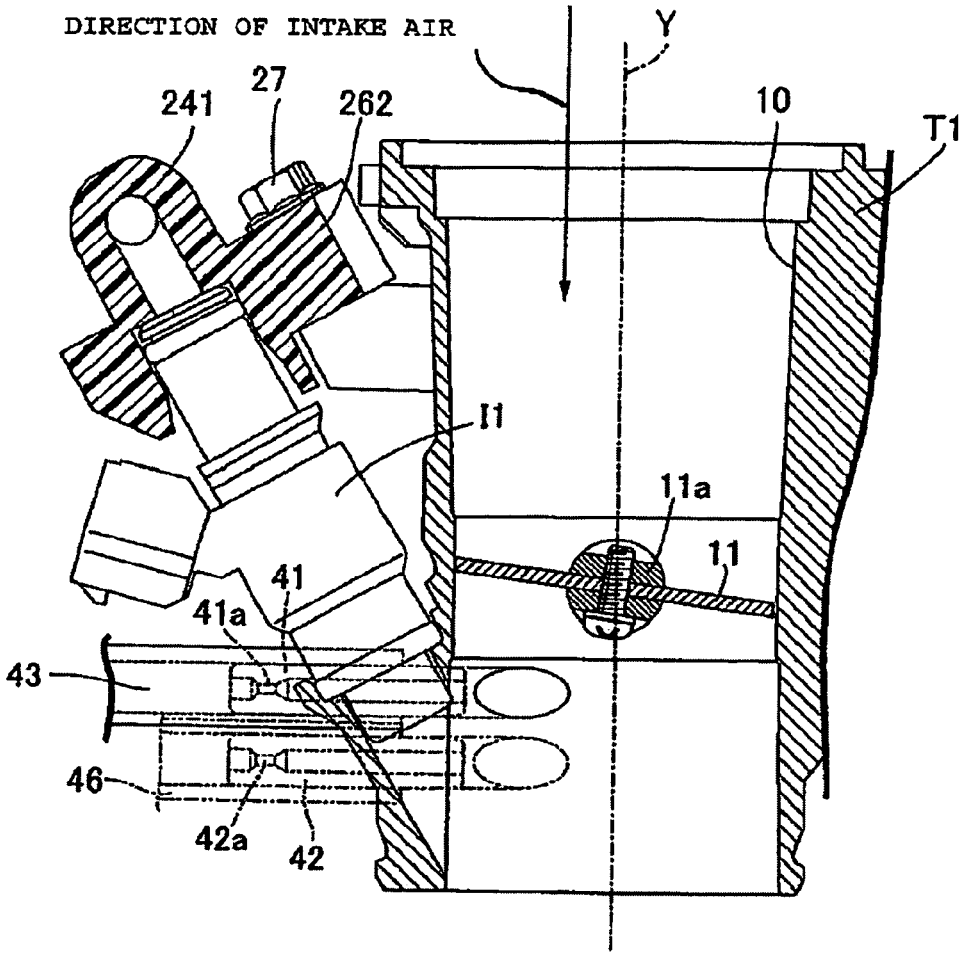
FIG. 8 is a cross-sectional view taken along line 8-8 of FIG. 7.

As shown in FIGS. 6 and 7, a rear wall of the first throttle body T1 and a front wall of the second throttle body T2 have respective first and second injection valve mount bosses 401, 402 that are open into the intake passages 10 downstream of the throttle valves 11. First and second electromagnetic fuel injection valves I1, I2 are mounted respectively on the first and second injection valve mount bosses 401, 402. When the fuel injection valves I1, I2 are opened, they inject a fuel into the downstream portions of the corresponding intake passages 10.

Figure 5:
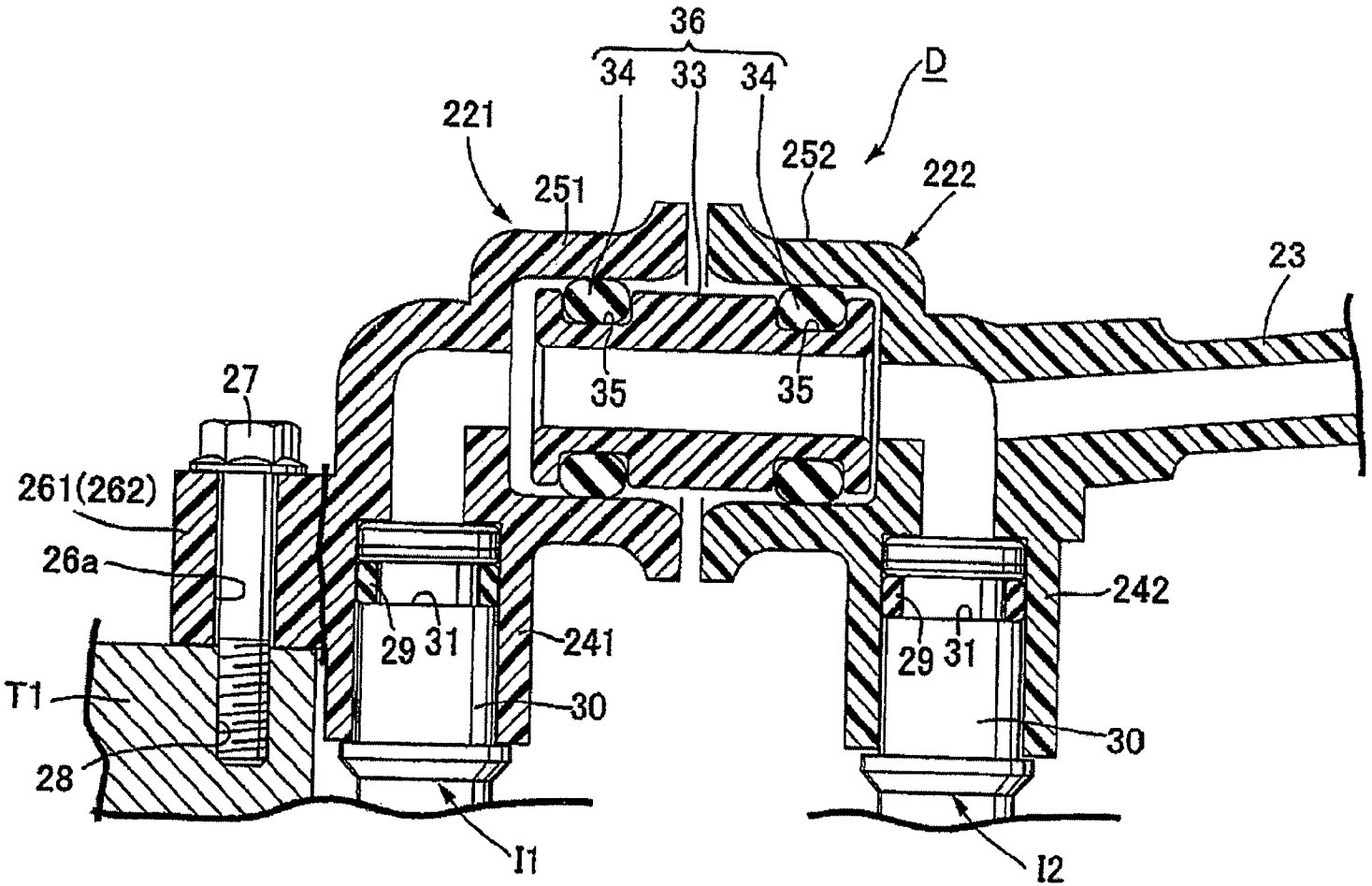
FIG. 5 is a cross-sectional view taken along line 5-5 of FIG. 3.

As shown in FIGS. 3 and 5, a fuel distribution tube D for distributing the fuel from a common fuel supply system 20 is connected to the fuel injection valves I1, I2. The fuel distribution tube D includes first and second distribution tubes 221, 222 which are individually molded of synthetic resin and separate from each other. The first distribution tube 221 includes an integral molded assembly of a first connecting cap 241 hermetically fitted over a fuel inlet pipe 30 of the first fuel injection valve I1 with a seal member 29 interposed therebetween, a first coupling tube 251 in the form of a bottomed hollow cylinder, and a pair of fastening bosses 261. The first connecting cap 241 and the first coupling tube 251 have their internal spaces held in fluid communication with each other.

The second distribution tube 222 includes an integral molded assembly of a joint tube 23 for connection to the common fuel supply system 20, a second connecting cap 242 hermetically fitted over a fuel inlet pipe 30 of the second fuel injection valve I2 with a seal member 29 interposed therebetween, a second coupling tube 252 in the form of a bottomed hollow cylinder, and a pair of fastening bosses 262. The second connecting cap 242 and the second coupling tube 252 have their internal spaces held in fluid communication with each other. The joint tube 23 may alternatively be included in the first distribution tube 221.

The first and second fastening bosses 261, 262 have respective bolt holes 26*a* defined therein. When bolts 27 extending through the respective bolt holes 26*a* are threaded and tightened into threaded holes 28 defined in the first and second throttle bodies T1, T2 at given positions thereon, the first and second fastening bosses 261, 262 are fastened to the first and second throttle bodies T1, T2. The first and second fuel injection valves I1, I2 are now held on the first and second injection valve mount bosses 401, 402. The seal members 29 are mounted in outer circumferential grooves 31 on the fuel inlet pipes 30 of the first and second fuel injection valves I1, I2.

The first and second coupling tubes 251, 252 are disposed coaxially with each other with their openings held closely to each other in confronting relation. A communication tube 33 has free ends loosely fitted in the first and second coupling tubes 251, 252. The communication tube 33 has annular grooves 35, 35 defined in the outer circumferential surfaces of opposite end portions thereof and receiving therein resilient seal members 34 held in close contact with the internal circumferential surfaces of the corresponding coupling tubes 251, 252. The communication tube 33 and the resilient seal members 34 jointly make up communication means 36 for providing fluid communication between the first and second distribution tubes 221, 222 and absorbing positional displacements thereof.

As shown in FIGS. 6 through 9, first and second connecting tubes 41, 42 which are open into the intake passage 10 downstream of the throttle valve 11 of the first throttle body T1 are press-fitted into the rear wall of the first throttle body T1. Similarly, first and second connecting tubes 41, 42 which are open into the intake passage 10 downstream of the throttle valve 11 of the second throttle body T2 are press-fitted into the front wall of the second throttle body T2. In the throttle bodies T1, T2, the first and second connecting tubes 41, 42 extend substantially perpendicularly to the axes Y of the intake passages 10 (see FIG. 8) and are disposed in sandwiching relation to the fuel injection valves I1, I2 (see FIG. 7). The first and second connecting tubes 41, 42 are offset from each other along the axes Y of the intake passages 10. Since the intake passages 10 are vertically arranged, the first and second connecting tubes 41, 42 are vertically offset from each other.

Specifically, in the throttle bodies T1, T2, the first connecting tubes 41 are disposed inwardly of the fuel injection valves I1, I2 along the direction of an offset e between the first and second throttle bodies T1, T2, and the second connecting tubes 42 are disposed outwardly of the fuel injection valves I1, I2 along the direction of the offset e. The first connecting tubes 41 are disposed upwardly of the second connecting tubes 42. The first connecting tubes 41, 41 of the respective first and second throttle bodies T1, T2 are thus disposed substantially in line with each other.

Purge conduits 43, 43 are connected respectively to the first connecting tubes 41, 41 of the first and second throttle bodies T1, T2 and also connected through a T-shaped first joint 44 to a single common purge conduit 430. The purge conduits 43 and the common purge conduit 430 are in the form of flexible pipes such as rubber pipes or the like, and the first joint 44 is made of a hard synthetic resin.

Since the first connecting tubes 41, 41 are held substantially in line with each other, as described above, the two purge conduits 43, 43 extending from the first connecting tubes 41, 41 of the first and second throttle bodies T1, T2 to the first joint 44 are also disposed substantially in line with each other. Therefore, the purge conduits 43, 43 can be as short as possible and can be made compact, and any bending of the purge conduits 43, 43 is minimized for reducing an increase in the cost.

The common purge conduit 430 is connected to a purge port of a canister 47 for storing an evaporated fuel produced in a fuel tank (not shown), for example. While the engine E is in operation, an evaporated fuel released from the canister 47 flows through the common purge conduit 430 and the two purge conduits 43, 43 and is distributed and drawn into the intake passages 10, 10 of the first and second throttle bodies T1, T2. The drawn evaporated fuel and an intake mixture flowing through the intake passages 10, 10 are supplied to the cylinders of the first and second banks B1, B2. The first connecting tubes 41 have respective first orifices 41*a* for limiting the rate of the evaporating fuel flowing into the intake pipes 10 to a constant level.

Vacuum conduits 46, 46 are connected respectively to the second connecting tubes 42, 42 of the throttle bodies T1, T2 and also connected through a T-shaped second joint 45 to a single common vacuum conduit 460. The vacuum conduits 46 and the common vacuum conduit 460 are in the form of flexible pipes such as rubber pipes or the like, and the second joint 45 is made of a hard synthetic resin.

The common vacuum conduit 460 is connected to a vacuum sensor 48 which may be mounted on the throttle bodies T1, T2 or the vehicle frame F. While the engine E is in operation, a vacuum developed in the intake passages 10 of the first and second throttle bodies T1, T2 downstream of the throttle valves 11 is introduced into the second connecting tubes 42, 42, is led through the vacuum conduits 46 and the common vacuum conduit 460, and is detected by the vacuum sensor 48. The vacuum sensor 48 generates a signal indicative of the vacuum detected thereby and hence the load on the engine E. The generated signal is used to control the rate at which the fuel is injected from the fuel injection valves I1, I2, the ignition timing, etc. The second connecting tubes 42 have respective second orifices 42*a* for attenuating pulsations of the vacuum introduced into the second connecting tubes 42.

Figure 9:
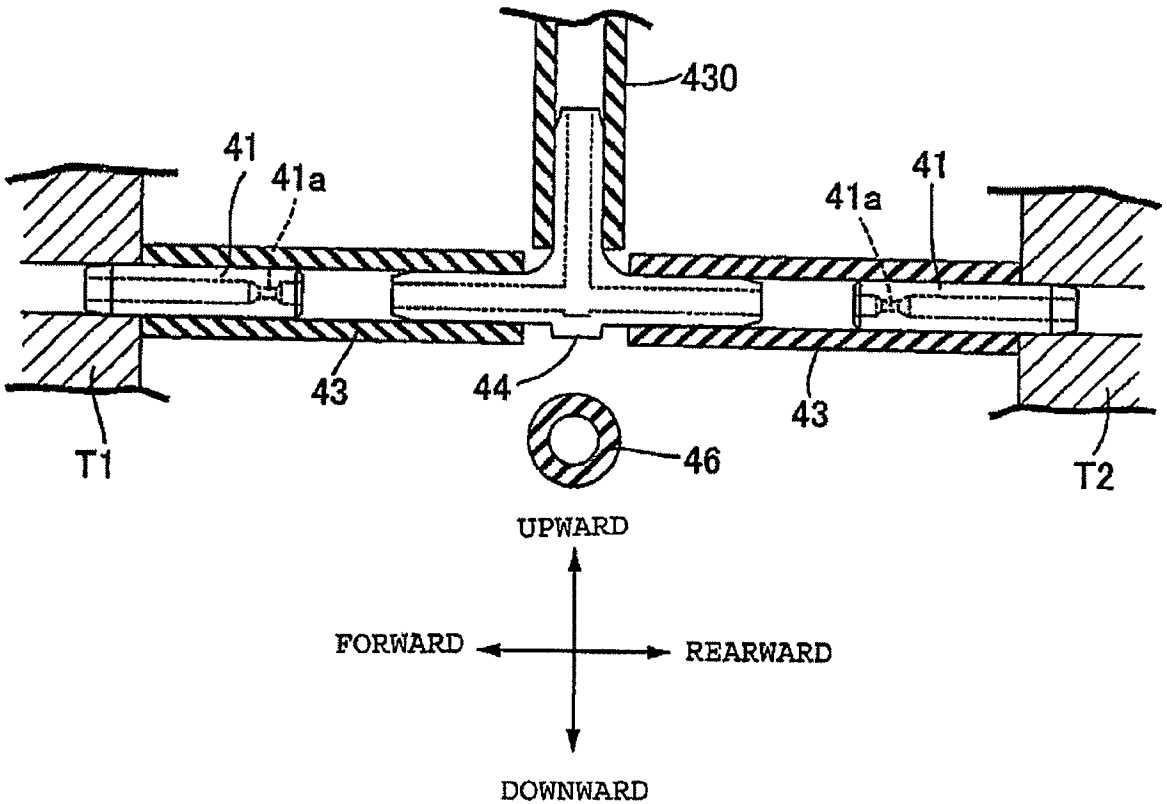
FIG. 9 is a cross-sectional view taken along line 9-9 of FIG. 6.

As shown in FIGS. 6 and 9, the first and second joints 44, 45 are disposed as follows: The first joint 44 is disposed such that the front and rear purge conduits 43, 43 interconnecting the first joint 44 and the first connecting tubes 41, 41 of the first and second throttle bodies T1, T2 are held substantially in line with each other. The common purge conduit 430 is connected downwardly to the first joint 44. The second joint 45 is disposed such that the vacuum conduits 46 interconnecting the second joint 45 and the second connecting tube 42 of the second throttle body T2 extends linearly. The vacuum conduit 46 which is connected to the second connecting tube 42 of the first throttle body T1 is bent through a right angle, passes below the first joint 44, and is connected to the second joint 45. The common vacuum conduit 460 is connected from a first throttle body T1 side to the second joint 45. Therefore, either one of the first and second joints 44, 45 is disposed in a three-dimensionally intersecting position of the purge conduits 43 and the vacuum conduit 46. In the illustrated embodiment, the first joint 44 interconnecting the purge conduits 43 is disposed in the three-dimensionally intersecting position of the purge conduits 43 and the vacuum conduit 46. Therefore, the vacuum conduit 46 passes below the first joint 44.

Operation of the present embodiment will be described below.

When the first and second connecting tubes 41, 42 that are open into the intake passages 10 substantially perpendicularly to the axes Y of the intake passages 10 are installed on the first and second throttle bodies T1, T2 connected to the first and second banks B1, B2 in the intake device of the V-shaped engine, the first and second connecting tubes 41, 42 are disposed in sandwiching relation to the corresponding fuel injection valves I1, I2, the purge conduits 43 are connected to the first connecting tubes 41, and the vacuum conduits 46 to the second connecting tubes 42. Therefore, the fuel injection valves I1, 12 and the first and second connecting tubes 41, 42 project compactly on outer surfaces of the throttle bodies T1, T2, making the intake device compact. The purge conduits 43 and the vacuum conduits 46 can be connected compactly and quickly to the first and second connecting tubes 41, 42. The fuel injection valves I1, I2, the first and second connecting tubes 41, 42, the purge conduits 43, and the vacuum conduits 46 are disposed in a dead space between the first and second throttle bodies T1, T2, contributing to making the intake device further compact.

When the first and second connecting tubes 41, 42 are installed on the first and second throttle bodies T1, T2, the first and second connecting tubes 41, 42 are offset from each other along the axes Y of the intake passages 10. Since the purge conduits 43, 43 extending from the first connecting tubes 41, 41 of the throttle bodies T1, T2 are connected through the first joint 44 to the single common purge conduit 430 and the vacuum conduits 46, 46 extending from the second connecting tubes 42, 42 of the throttle bodies T1, T2 are connected through the second joint 45 to the single common vacuum conduit 460 between the first and second throttle bodies T1, T2, the purge conduit 43 system and the vacuum conduit 46 system are vertically arranged, and their tubes are compactly put together without mutual interference.

The side surfaces of the first and second throttle bodies T1, T2 are coupled to each other by the first coupling plate 5 and the respective opposite side surfaces thereof are coupled to each other by the second coupling plate 7, thereby making up the throttle body assembly TA. The throttle body assembly TA can easily be disposed between the first and second banks B1, B2. Since a junction between the purge conduits 43, 43 and the common purge conduit 430, i.e., the first joint 44, and a junction between the vacuum conduits 46, 46 and the common vacuum conduit 460, i.e., the second joint 45, are disposed between the first and second coupling plates 5, 7, the purge conduits 43, the vacuum conduits 46, and the first and second joints 44, 45 are protected from contact with other objects by the first and second coupling plates 5, 7.

The purge conduits 43, 43, the common purge conduit 430, the vacuum conduits 46, 46 and the common vacuum conduit 460 are made of a flexible material, and the first and second joints 44, 45 are made of a hard synthetic resin, so that the purge conduits 43 and the common purge conduit 430 can easily be connected to each other, and the vacuum conduits 46 and the common vacuum conduit 460 can easily be connected to each other. As either one of the first and second joints 44, 45 is disposed in a three-dimensionally intersecting position of the purge conduits 43 and the vacuum conduit 46, the purge conduits 43 and the vacuum conduits 46 which are made of the flexible material are held out of contact with each other and hence are of increased durability.

While the embodiment of the present invention has been described above, the present invention is not limited to the above embodiment, but various design changes may be made without departing from the scope of the invention. For example, in the throttle bodies T1, T2, the first and second connecting tubes 41, 42 may be vertically switched around, i.e., the first connecting tubes 41 connecting the purge conduits 43 may be disposed below the second connecting tubes 42 connecting the vacuum conduits 46. The second connecting tubes 42, 42 of the throttle bodies T1, T2 may be disposed substantially in line with each other. The first and second connecting tubes 41, 42 may be integrally formed with the corresponding throttle bodies T1, T2. The coupling plates 5, 7 may be replaced with coupling arms for being bolted to each other which are integrally formed with the first and second throttle bodies T1, T2. The vacuum introduced into the second connecting tubes 42 may be used as a vacuum source for a vacuum actuator.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

I claim:

1. An intake device for a multicylinder engine, comprising:

a plurality of throttle bodies, each throttle body having an intake passage and a throttle valve for opening and closing said intake passage, a plurality of fuel injection valves, each fuel injection valve being mounted on one of said plurality of throttle bodies for injecting fuel into each said intake passage downstream of each said throttle valve, a plurality of vacuum conduits for drawing a vacuum from each said intake passage, a plurality of purge conduits for guiding an evaporated fuel from a canister for storing the evaporated fuel to each said intake passage, a plurality of first connecting tubes, each first connecting tube opening into one of said intake passages in a direction substantially perpendicular to an axis of said intake passage, and a plurality of second connecting tubes, each second connecting tube opening into one of said intake passages in a direction substantially perpendicular to the axis of said intake passage, wherein each of said plurality of first connecting tubes and each of said plurality of second connecting tubes are disposed to sandwich a respective one of said plurality of fuel injection valves along a direction which is perpendicular to axes of said first connecting tubes and said second connecting tubes and which intersects with the axis of said intake passage, wherein each of said plurality of purge conduits is connected to one of said plurality of first connecting tubes, and wherein each of said plurality of vacuum conduits is connected to one of said plurality of second connecting tubes.

2. The intake device for the multicylinder engine according to claim 1, wherein said multicylinder engine is a V-shaped engine having a V-shaped array of first and second banks, each of said first and second banks having at least one cylinder, wherein said plurality of throttle bodies are mounted respectively on said first and second banks with said intake passages being directed vertically, wherein said first connecting tubes and second connecting tubes are spaced from each other along a direction of an offset between the axes of said plurality of intake passages, wherein said plurality of purge conduits and a single common purge conduit are connected to each other through a first joint positioned between said throttle bodies, and wherein said plurality of vacuum conduits and a single common vacuum conduit are connected to each other through a second joint positioned between the throttle bodies.

3. The intake device for the multicylinder engine according to claim 2, wherein each of said throttle bodies is connected to one of said first and second banks, and wherein said plurality of throttle bodies are offset from each other along the axis of a crankshaft by an interval corresponding to an offset between said first and second banks, such that either (i) said plurality of first connecting tubes are disposed substantially in line with each other or (ii) said plurality of second connecting tubes are disposed substantially in line with each other.

4. The intake device for the multicylinder engine according to claim 3, wherein first side surfaces of said plurality of said throttle bodies are coupled to each other by a first coupling plate and second side surfaces of said plurality of throttle bodies are coupled to each other by a second coupling plate, and wherein said plurality of purge conduits, said plurality of vacuum conduits, said first joint, and said second joint are disposed between said first coupling plate and second coupling plate.

5. The intake device for the multicylinder engine according to claim 2, wherein said plurality of purge conduits, said common purge conduit, said plurality of vacuum conduits, and said common vacuum conduit are made of a flexible material, wherein said first and second joints are made of a hard synthetic resin, and wherein either (i) said first joint is disposed in a three-dimensionally intersecting position with at least one of said plurality of vacuum conduits or (ii) said second joint is disposed in a three-dimensionally intersecting position with at least one of said plurality of purge conduits.

* * * * *